United States Patent [19]

Odajima

[11] Patent Number: 5,072,806

[45] Date of Patent: Dec. 17, 1991

[54] DIAPHRAGM FOR ACOUSTIC EQUIPMENT

[75] Inventor: Hideo Odajima, Fujioka, Japan

[73] Assignee: Mitsubishi Pencil Co., Ltd., Tokyo, Japan

[21] Appl. No.: 276,015

[22] Filed: Nov. 25, 1988

[51] Int. Cl.[5] ..... G10K 13/00; H04R 7/00

[52] U.S. Cl. ..... 181/170

[58] Field of Search ..... 181/170, 157, 169; 428/408

[56] References Cited

U.S. PATENT DOCUMENTS 4,618,591 10/1986 Okamura et al. ..... 428/408 X

FOREIGN PATENT DOCUMENTS 0121726 9/1979 Japan ..... 181/170
0018118 5/1980 Japan ..... 181/169
0163997 12/1980 Japan ..... 181/170
0105694 6/1983 Japan ..... 181/170
0288600 11/1988 Japan ..... 181/157

*Primary Examiner*—Brian W. Brown

[57] ABSTRACT

A diaphragm for acoustic equipment wherein a surface-hardened layer of SiC film is formed on the surface of the diaphragm substrate comprising a completely carbonaceous film. Thus, the diaphragm for acoustic equipment having superior acoustic characteristics by utilizing the superior physical characteristics of carbon can be used effectively as a diaphragm for digital-audio equipment which are now very popular.

5 Claims, 1 Drawing Sheet

DIAPHRAGM FOR ACOUSTIC EQUIPMENT

BACKGROUND OF THE INVENTION

The present invention relates to a diaphragm for acoustic equipment. More particularly, the present invention relates to a diaphragm for acoustic equipment having superior acoustic characteristics as a diaphragm for speakers and microphones because of its higher hardness, higher strength, higher elasticity and lighter weight compared with the conventional diaphragm materials.

In general, a diaphragm for speakers and the like meets desirably the following conditions:

(1) Its density is small;

(2) Its Young's modulus is small;

(3) Its propagation velocity of longitudinal waves is high;

(4) Its inner vibration loss is suitably large.

Besides, the formula $$V=(E/\rho)^{\frac{1}{2}}$$

(wherein, V: sound velocity; E: Young's modulus; $\rho$: density) requires a material of small density and high Young's modulus in order to increase the sound velocity.

Conventionally, as acoustic diaphragms having high Young's modulus, those using light metals such as aluminum titanium, magnesium, beryllium, boron, etc. are well-known.

However, acoustic diaphragms using aluminum, titanium, magnesium, etc. have no satisfactory specific Young's modulus $E/\rho$, and acoustic diaphragms using beryllium, boron, etc. have very large specific Young's modulus, but these materials are very expensive and extremely difficult to work industrially, which results in a very high cost as compared with those using other materials.

SUMMARY OF THE INVENTION

The object of the present invention is to provide a diaphragm having superior acoustic characteristics by utilizing the superior physical characteristics of carbon in consideration of the said disadvantages of the conventional diaphragm materials.

As is well-known, carbon has, from crystalline carbon such as diamond, graphite, etc. to non-crystalline carbon such as carbon black, charcoal, etc., very wide physical and chemical characteristics.

The inventor of this application has made an enthusiastic study in order to obtain the intended various functional characteristics by designing and combining these materials according to the required functions. He has already invented a method for manufacturing a completely carbonaceous diaphragm obtained by preforming a mixture of thermosetting resin and carbon powder as a raw material into a film, molding the film into a diaphragm shape, and sintering it in an inert atmosphere, and has made an application for patent (Unscreened Publication No. Sho 60-121895). He has also invented a method for manufacturing a glassy carbonaceous diaphragm by using only a thermosetting resin as a raw material, and has made an application for patent (Unscreened Publication No. Sho 61-65596). Although the diaphragms according to these inventions can be economically manufactured industrially, and have superior physical characteristics, the inventor of this application has made an enthusiastic study in order to improve the physical characteristics of these diaphragms, and has succeeded in inventing a diaphragm having superior acoustic characteristics to those comprising only a full carbonaceous film by evaporating a SiC film from a gaseous phase onto the surface of the diaphragm material comprising a full carbonaceous film as a result of having perceived that SiC has a very high propagation velocity of 11,000 m/s. The well-known synthesizing methods for evaporating a SiC film from a gaseous phase include thermal-CVD method, laser-CVD method, plasma-CVD method, etc., and any of these methods can be used in the present invention. The thermal expansion coefficient of a SiC film is preferably the same or similar with that of a completely carbonaceous film. The thermal expansion coefficient of SiC is $3.5\sim5.5\times10^{-6}$/°C., while that of glassy carbon is $2\sim3.5\times10^{-6}$/°C., and a carbon/carbon composite composed of carbon powders can be in the range of $3\sim5\times10^{-6}$ according to the content of added carbon powder. According to the method used for synthesizing SiC, there are some cases where the thermal expansion coefficient of a carbonaceous substrate must be adjusted by selecting the mixing ratio of carbon powders, optionally as necessary.

DESCRIPTION OF THE PREFERRED EMBODIMENTS

Figure 1:
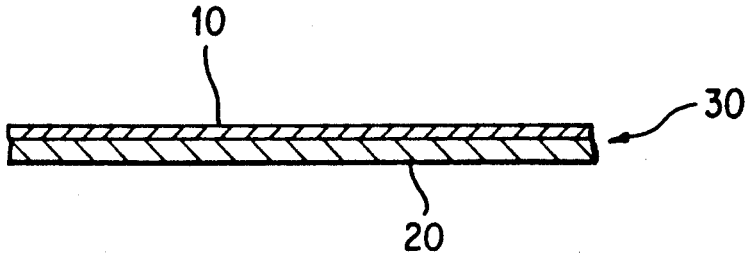
FIG. 1 is a cross section of the multilayer acoustical diaphragm of the present invention.

In the following, the present invention is described in detail as related to the examples, but the present invention is not limited to the examples.

EXAMPLE 1

4 wt. % of 50% liquid methanol p-toluenesulfonic acid was added as a hardener to 100 wt. % of an initial condensate of furfuryl alcohol/furfural resin (UF-302 manufactured by HITACHI KASEI CO., LTD.). After being stirred sufficiently by a high speed mixer, the mixture thereof was coated on a back sheet by a coater having a doctor blade, and was then prehardened to obtain thereby a preformed sheet in a B-stage.

After the back sheet was removed, the preformed sheet was molded into a dome shape by a vacuum molder, hardened by heating, and released from the mold to obtain a diaphragm molding. An after-hardening treatment was applied to this molding for 5 hours in an air oven of 150° C. Thereafter the sintering of the molding was completed by heating it in an oven of nitrogen gas atmosphere at the heating rate of 15° C./hour till 500° C. and at that of 50° C./hour between 500°~1000° C., maintaining it for 3 more hours at 1000° C. and allowing it to cool down naturally. The thus obtained glassy carbonaceous diaphragm having a diameter of 25 mm and a film thickness of 25 μm was used as a substrate, and a SiC film was evaporated thereon by a well-known CVD method.

In synthesizing the SiC film, the flow rates of hydrogen, methane and silicon tetrachloride shall be 1 lit./min., 3 ml./min., and 3 ml./min. respectively, and the mixture thereof is introduced into a bell jar under the pressure of 1 torr. On the other hand, the substrate was maintained at a temperature of 500° C., plasma was induced by microwaves of 2.45 GHz, and the evaporation was performed for 2 hours. The obtained SiC film had a thickness of 5 μm.

EXAMPLE 2

80 wt. % of an initial condensate of furfuryl alcohol/-furfural resin (UF 302 manufactured by HITACHI KASEI CO., LTD.) and 20 wt. % of natural flaky graphite (average grain size: 1 μm) were mixed and dispersed homogeneously in a Warner mixer, and were thereafter highly dispersed by using 3 ink kneading rolls to obtain a raw material paste composition. 4 wt. % of 50% liquid methanol p-toluenesulfonic acid was added as a hardener to 100 wt. % of the raw material paste composition, and the same procedures as in Example 1 were repeated to obtain a completely carbonaceous diaphragm having a diameter of 25 mm and a film thickness of 40 μm. This completely carbonaceous diaphragm was used as a substrate, and a SiC film was evaporated thereon by a well-known CVD method.

In synthesizing the SiC film, the flow rates of hydrogen, methane and silicon tetrachloride shall be 1 lit./-min., 1 ml./min. and 3 ml./min. respectively, and the mixture thereof is introduced into a bell jar under the pressure of 30 torr. On the other hand, the completely carbonaceous substrate was maintained at a temperature of 1500° C. by high frequency induction heating, and the evaporation was performed for 40 minutes. The obtained SiC film had a thickness of 5 μm.

The characteristics of the diaphragm obtained according to the present invention are compared with those of the conventional diaphragms in the following table.

| Material | Sound Velocity km/sec. | Young's Modulus GPa | Density g/cm$^3$ |
|---|---|---|---|
| Aluminium | 5.1 | 70.0 | 2.70 |
| Titanium | 4.9 | 110.0 | 4.50 |
| Beryllium | 12.2 | 270.0 | 1.80 |
| Example 1 (Substrate) | 7.5 | 78.0 | 1.40 |
| Example 2 (Substrate) | 9.0 | 115.0 | 1.43 |
| Example 1 | 8.4 | 110.0 | 1.55 |

-continued

| Material | Sound Velocity km/sec. | Young's Modulus GPa | Density g/cm$^3$ |
|---|---|---|---|
| (After Evaporation) | | | |
| Example 2 (After Evaporation) | 9.7 | 163.0 | 1.73 |

As shown clearly in this table, both in Examples 1 and 2, the physical characteristics of the substrate were improved about 40% for Young's modulus and about 10% for sound velocity as compared with those of the substrate before evaporation. Moreover, the effects of the present invention are not limited to the examples, and it is possible to improve the physical characteristics further by increasing the thickness of the evaporated film.

Because of these superior characteristics, the diaphragm according to the present invention can be used effectively as a diaphragm for digital-audio equipment which are now very popular.

Figure 2:
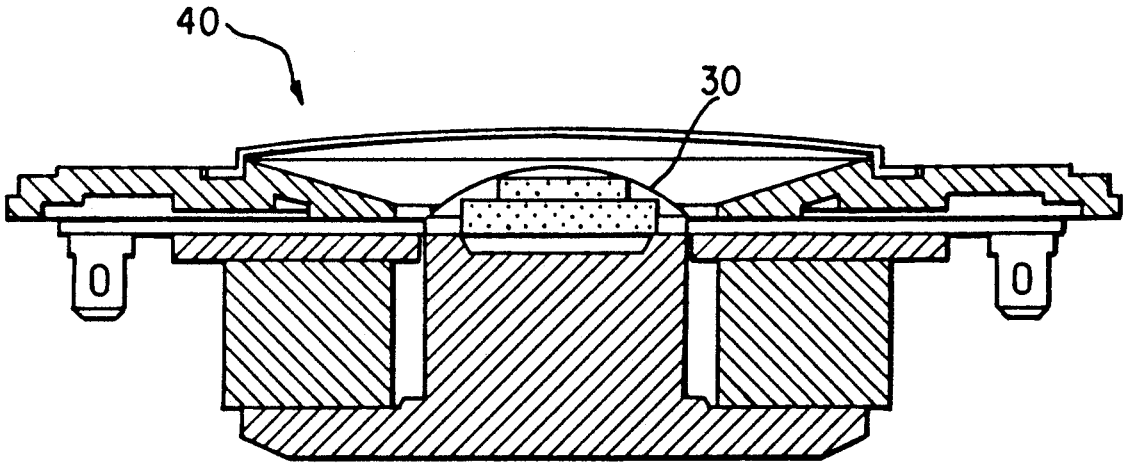
FIG. 2 is a cross section of a speaker assembly which employs the multilayer acoustical diaphragm of FIG. 1.

The multilayer acoustical diaphragm of the present invention is illustrated by FIG. 1, which depicts SiC film 10 deposited upon carbonaceous film 20. FIG. 2 illustrates the multilayer acoustical diaphragm 30 of FIG. 1 as part of assembly 40.

What is claimed is:

1. A multilayer diaphragm for acoustic equipment comprising only two layers, a completely carbonaceous base layer and a SiC film surface layer on at least one surface of said base layer, said diaphragm having a sound velocity about 10% greater and a Young's modulus about 40% greater than said base layer without the SiC film surface layer.

2. A multilayer diaphragm as in claim 1, wherein said sound velocity is at least about 8.4 km/sec. and said Young's modulus is at least about 110.0 GPa.

3. A multilayer diaphragm as in claim 1, wherein said sound velocity is between about 8.4 and about 9.7 km/sec. and said Young's modulus is between about 110.0 and about 163.0 GPa.

4. A multi-layer diaphragm as claimed in claim 1 wherein said base layer has a thickness of 25 to 40 micrometers.

5. A multi-layer diaphragm as claimed in claim 1 wherein said surface layer has a thickness of at least 5 micrometers.

* * * * *